US005215649A

United States Patent [19]

Grenoble et al.

[11] Patent Number: 5,215,649

[45] Date of Patent: Jun. 1, 1993

[54] METHOD FOR UPGRADING STEAM CRACKER TARS

[75] Inventors: Dane C. Grenoble; Roy T. Halle, both of Houston, Tex.; Martin L. Gorbaty, Westfield, N.J.; Harold W. Helmke, Kingwood, Tex.

[73] Assignee: Exxon Chemical Patents Inc., Linden, N.J.

[21] Appl. No.: 517,994

[22] Filed: May 2, 1990

[51] Int. Cl.[5] ..... C10G 57/00

[52] U.S. Cl. ..... 208/95; 208/106; 208/48 Q; 208/48 R; 208/142; 208/125; 585/476; 585/486; 585/484

[58] Field of Search ..... 585/486, 484, 476; 208/56, 57, 95, 48 Q

[56] References Cited

U.S. PATENT DOCUMENTS

| | | | |
|---|---|---|---|
| 2,873,245 | 2/1959 | Thomson et al. | 208/56 |
| 2,953,513 | 9/1960 | Langer, Jr. | 208/53 |
| 3,429,942 | 2/1964 | Nelson | 585/486 |
| 3,483,266 | 12/1964 | Hill | 585/484 |
| 3,484,527 | 11/1966 | Gill | 585/484 |
| 3,485,883 | 12/1969 | Engelbrecht | 585/484 |
| 3,623,973 | 11/1971 | Tarhall | 585/486 |
| 3,755,143 | 8/1973 | Hosoi et al. | 208/67 |
| 4,260,474 | 4/1981 | Wernicke et al. | 208/57 |
| 4,284,139 | 8/1981 | Sweany | 208/56 |
| 4,324,935 | 4/1982 | Wernicke et al. | 585/314 |
| 4,397,830 | 8/1983 | Uemura et al. | 208/22 |
| 4,430,197 | 2/1984 | Poynor et al. | 208/56 |
| 4,596,652 | 6/1986 | Shibatani et al. | 208/22 |
| 4,599,470 | 7/1986 | Gregory et al. | 585/486 |
| 4,604,185 | 8/1986 | McConaghy, Jr. et al. | 208/56 |
| 4,615,791 | 10/1986 | Choi et al. | 208/56 |
| 4,857,168 | 8/1989 | Kubo et al. | 208/56 |
| 4,966,679 | 10/1990 | Kubo et al. | 208/56 |
| 5,003,119 | 3/1991 | Sardina | 585/486 |
| 5,045,174 | 9/1991 | Grenoble | 208/57 |

*Primary Examiner*—Helane Myers
*Attorney, Agent, or Firm*—Linda K. Russell

[57] ABSTRACT

A process for the production of gaseous olefins which involves introducing a hydrocarbon feedstock stream into a high temperature thermal cracking zone to produce a high temperature cracked product stream, quenching the cracked product stream to stop the cracking reactions, injecting at least one HDD (hydrogen donor diluent) into the cracked product stream at or downstream of the point at which the reaction is quenched, recovering normally gaseous olefins from the cracked product stream, and recovering a liquid product stream containing a diminished asphaltene content.

38 Claims, 1 Drawing Sheet

METHOD FOR UPGRADING STEAM CRACKER TARS

BACKGROUND OF THE INVENTION

1. Field of the Invention

The present invention is directed to processes for the production of normally gaseous mono- and di-olefins, particularly ethylene, propylene and butadiene, by thermally cracking a hydrocarbon feedstock in the presence of steam at elevated temperatures which involves introducing a hydrogen donor material, such as hydrotreated steam cracked tar oils, into a stream of steam cracked effluent at or downstream of the point where the furnace effluent reactions are quenched so as to prevent thermal degradation reactions of the steam cracked liquids.

2. Discussion of Background and Material Information

The use of hydrogen donor chemistry to in some manner alter or control the thermal conversion of hydrocarbon oils is known in the art. For example, U.S. Pat. Nos. 2,953,513 and 2,873,245, commonly owned with the present application, issued in 1959 and 1960, are directed to the concept of hydrogen donor diluent cracking (HDDC). In such processes, hydrogen donor oils, which are generally hydrotreated aromatic oils, are used to control and/or enhance the thermal cracking of heavy hydrogen deficient oils such as residua.

U.S. Pat. No. 4,284,139, SWEANY, is directed to a process for upgrading the oil production from a heavy oil reservoir by contacting the heavy oil with a hydrogen donor diluent and subjecting the mixture to thermal cracking in a hydrogen donor diluent furnace. The disclosed purpose for doing so is to break down the heavy molecules which already exist in naturally occurring heavy oils. Thus, SWEANY uses a variation of the conventional HDDD process to enhance the stimulation and upgrading of oil production from heavy oil reserves.

U.S. Pat. No. 4,430,197, POYNOR et al., is directed to a hydrogen donor diluent cracking process in which heavy hydrocarbonaceous material is thermally cracked in a cracking coil in the presence of a hydrogen donor solvent. POYNOR et al., therefore, also uses a variation of a conventional HDDC process, which involves heat soaking, in the presence of a hydrogen donor, pitch obtained from the HDDC process. This heat-soaked pitch is then recycled and cracked in the hydrogen donor diluent process.

U.S. Pat. No. 4,397,830, UEMURA et al., is directed to a process for producing carbon fibers which involves heat treating a feed stock pitch by mixing 100 parts by volume of a heavy fraction oil boiling not lower than 200° C. obtained by steam cracking petroleum with 10 to 200 parts by volume of a hydrogenated oil selected from a group consisting of aromatic nucleus hydrogenated hydrocarbons of appropriate carbon ring number and/or boiling range including hydrogenated cat cracked oil.

U.S. Pat. No. 4,596,652, SHIBATANI et al., is directed to a process for producing a mesophase pitch for carbon filter production, which involves pretreating the raw pitch material at elevated temperature under a pressurized hydrogen atmosphere followed by heat treating the pitch at 350° C. to 550° C. while supplying the pitch with a hydrogen donor.

UEMURA et al. and SHIBATANI et al. both teach the use of hydrogen donors to control or modify the heat soaking of pitches to produce preferred feeds for the production of carbon fibers. In this regard, these references disclose that the hydrogen donors mitigate the formation of quinoline insolubles during heat soaking of the starting pitch. Quinoline insolubles are undesirable for carbon fiber production and are conventionally classified as higher molecular weight asphaltenes or coke.

U.S. Pat. No. 3,755,143, HOSOI et al., teach the pyrolysis of crude oil or fractions thereof, followed by desulfurization by hydrogenation of the polycyclic aromatic tar produced in the pyrolysis reaction followed by alkylation or hydrogenation of the resultant product using the hydrogen produced in the pyrolysis reaction. Thus, HOSOI et al. disclose the hydrogenation of SCT to produce an improved product using conventional catalysis to accomplish their hydrogenation step.

U.S. Pat. No. 4,260,474, WERNICKE et al., relate to thermal cracking of heavy fractions of hydrocarbon hydrogenates. The disclosed process involves hydrogenation of VGO at a temperature of about 340° C. and subsequent recovery of a hydrogenated VGO boiling above about 340° C. which is then steam cracked to produce naptha-like cracked yields. Although reference is made to hydrogenation, typically 40% or more of the starting VGO material is converted, i.e., hydrocracked, material boiling above about 340° C. in the hydrogenation step.

U.S. Pat. No. 4,324,935, WERNICKE et al., relates to a similar process to WERNICKE et al., supra, which involves an improved hydrogenation step which results in high quality fractions, i.e., gasoline materials. The 200° C.–340° C. boiling range hydrogenated product is steam cracked and then recycled to the hydrogenation step, which again is more of a hydrocracking than an hydrogenation because of the severity of the conversion of the starting material.

SUMMARY OF THE INVENTION

The present invention is directed to a method of hydrogen donor chemistry wherein polymerization/-condensation reactions of asphaltene precursors to form asphaltenes are prevented or mitigated by introducing a hydrogen donor diluent (HDD) material into a steam cracked effluent stream so as to upgrade the tars formed during the production of gaseous olefins.

In accordance with the present invention, hydrogen donor diluents (HDD) or solvents, i.e., hydrotreated aromatic oils (e.g., recycled, hydrogenated oils derived from the steam cracked liquids) are used to upgrade SCT by injecting the HDD at or after the quench point or transfer line exchanger of a gas oil steam cracker furnace in order to prevent thermal degradation reactions of the steam cracked liquids.

The point of introduction of the hydrogen donor material is selected to minimize heatsoaking time of the steam cracked liquids at elevated temperatures where liquid phase molecular weight growth reactions can proceed readily in the absence of the hydrogen donor.

Chemical reactions which lead to molecular weight growth of steam cracked liquids and the hydrogen donor chemistry which can inhibit the molecular weight growth reactions take place in the liquid phase; therefore, the boiling range of the HDD should be selected such that HDD boiling range overlies the boiling range of the steam cracked product liquids to best carry out the hydrogen donor chemistry.

One embodiment of the present invention is a process for upgrading SCT in which fresh SCT is combined with hydrotreated steam cracked tar (SCT) oil, heavy distillate oil cuts thereof or aromatic oils in order to permit hydrogen donor (transfer) reactions which have been found to result in lower asphaltene formation in the SCT stream. Preferably,the HDD has overlapping boiling ranges with the SCT, and include hydrotreated cat cycle oils, coker gas oils, steam cracked tar oils, and coal tars. Also preferably, the HDD is added at or immediately downstream of the point where the furnace effluent is quenched and upstream of the primary fractionator or quench tower since, at the temperatures which normally prevail in steam cracker primary fractionator towers, the molecular weight growth reactions which lead to asphaltene formation are rather fast and are not as easily reversed as they are prevented.

A preferred embodiment of the present invention is a process for improving the properties of steam cracked tar (SCT) which involves first hydrogenating SCT or distillate cuts of SCT to produce HDD, which is combined with a freshly produced SCT at or after the point where the furnace effluent gas phase reactions are thermally quenched in a gas oil steam cracker in order to prevent subsequent thermal degradation reactions of SCT.

BRIEF DESCRIPTION OF DRAWINGS

The above and other objects, features and advantages of the present invention will be more particularly described hereinafter with respect to the accompanying drawing, which illustrate one embodiment of the invention presented by way of non-limiting example, and in which.

DETAILED DESCRIPTION

Figure 1:
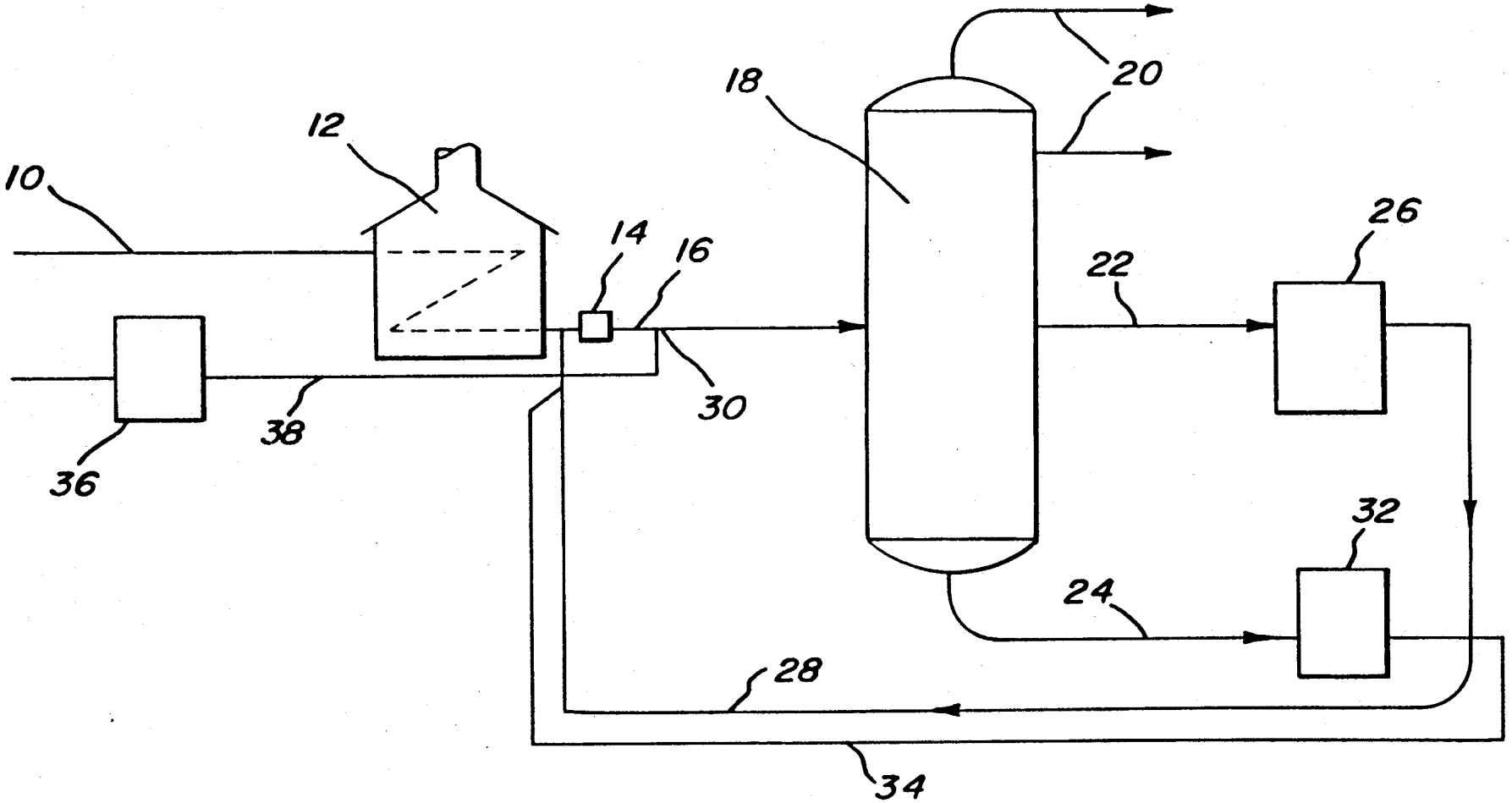
FIG. 1 is a simplified flowchart of a hydrogen donor solvent recycle system which may be used in accordance with the present invention wherein the HDD is introduced to the SCT at the point of quenching of the steam cracking furnace effluent or a point downstream of the point of quenching of the effluent but upstream of the flash zone of the Primary Fractionator Tower.

In conventional chemical manufacturing processes, steam cracker tars (SCT) are a typical undesirable side product. It has been shown that the value of SCT is improved by the addition of donor hydrogen under controlled conditions. In accordance with the present invention, donor diluents or solvents, such as whole steam cracked tar (SCT) oil, or a product derived from solvent cuts which are subsequently hydrotreated, for example in a recycled solvent system, may be used for this purpose to upgrade SCT. It has been discovered that hydrogen donor reactions between SCT and hydrogen donor-containing streams are effective in upgrading SCT by preventing or suppressing the formation of asphaltenes in the SCT which would otherwise occur by thermal degradation reactions.

Related to this, it has been discovered that partially hydrotreated whole steam cracked tar (SCT) oils, partially hydrotreated heavy distillate oil cuts thereof, and partially hydrotreated aromatic oils, which are hydrocarbon streams rich in multi-ring compounds in which at least one ring is an aromatic ring and at least one ring is partially to fully saturated, are suitable hydrogen donor-diluents (HDD) useful to promote hydrogen donor reactions with SCT. For example, suitable hydrogen donor diluents include partially saturated aromatic molecules selected from the group consisting of dihydronaphthalenes, tetrahydronaphthalenes, dihydroanthracenes, dihydrophenanthrenes, tetrahydroanthracenes, tetrahydrophenanthrenes, hydropyrenes, and other hydrogenated aromatic oils, such as steam cracked liquid products, cat cracker cycle oils, coker gas oils, and coal tar liquids. In this regard, hydrogen donor diluents particularly suitable for purposes of the present invention, include such materials as tetralin; 9, 10-dihydroanthracene; 9, 10- dihydrophenanthrene; hydropyrene, 1, 2, 3, 4-tetrahydroquinoline, and other similar compounds. The hydrogen donor materials may also be mixed streams, for example having generally naphthenoaromatic characteristics. In addition, partially hydrogenated, condensed, polycyclic aromatic or nitrogen-containing heterocyclic compounds are suitable for purposes of the present invention, with partially hydrogenated catalytic cracking cycle oils, hydrogenated aromatic concentrate streams from dearomatization processes, hydrogenated coker gas oils, and hydrogenated coal tar liquids being preferred hydrogen donor compounds. Especially preferred hydrogen donor compounds for purposes of the present invention are materials which have boiling ranges i.e., about 400° F. to about 750° F., which overlap the liquid products of the steam cracking process, such as hydrotreated catalytic cracking cycle oils, aromatic concentrate streams from dearomatization processes, coker gas oils, coal tar liquids and steam cracked tar oils.

The present invention is based on the discovery that upon mildly hydrotreating aromatic oils, partially saturated aromatics are formed which are active hydrogen donor molecules which upon reaction with steam cracked liquid products prevent, minimize or suppress molecular weight growth reactions which form undesirable high molecular weight materials such as asphaltenes. Suitable hydrotreated aromatic oils include, but are not restricted to, hydrotreated aromatic rich streams, such as steam cracked tar or steam cracked tar distillates, cat cycle oils, coker gas oils, coal tar liquids, and lube extract streams. As previously indicated, for most preferred results, it is preferable that the hydrotreated aromatic oils have boiling ranges similar to the steam cracked liquid products because these hydrogen donor reactions are best effected in the liquid phase, with hydrogenated steam cracked tar oils being most preferred.

The process in which SCT is reacted with hydrogen donor-containing aromatic oils, such as steam cracked tar oil, is preferably accomplished by mixing the SCT and the hydrotreated aromatic oil at, or substantially immediately after, the quench point of the steam cracker furnace. To this end, whole steam cracked tar (SCT) oil, or a heavy distillate oil cut of SCT, may be initially hydrotreated to mildly hydrogenate the contained aromatic ring systems to produce hydrogen donor molecules. Subsequently, the hydrogenated oil is injected at, or substantially immediately after, the quench point of a gas oil stream cracker furnace to react with fresh SCT product so as to produce a SCT product of improved quality relative to conventional processes in which non- hydrogenated oils are used to quench the steam cracking reactions.

Although not wishing to be bound by any particular theory, it is believed that the steam cracked liquid product, as first produced in the steam cracker furnace, contain free radical molecules, vinyl-aromatic molecules, and other reactive species, and is highly reactive at moderately high temperatures commonly found in the downstream processing of steam cracked liquid product. The unsaturated functional groups of such aromatic molecules include those selected from the group consisting of olefinic groups and acetylenic groups. More specifically, such unsaturated functional groups are selected from the groups consisting of indenes, acenapthalenes and other cyclopenteno-aromatics; vinylbenzenes, and other vinyl aromatics having one aromatic ring; divinylbenzenes, vinylnaphthalenes, divinylnaphthalenes, vinylanthracenes, vinylphenanthrenes, and other vinyl- and divinylaromatics having 2 or more aromatic rings. This reactivity of such aromatic molecules tends to lead to reactions which significantly downgrade the properties of the liquid product. Thus, it is believed that mixing hydrogen donor molecules with the steam cracked liquid product containing such aromatic molecules, and preferably heavy hydrogen donor molecules boiling in the same range as the steam cracked liquid product, at or after the point where the high temperature gas phase reactions are quenched and the steam cracked liquid products first condense, facilitates hydrogen donor reactions which prevent subsequent degradation reactions of the liquid product.

Notwithstanding the particular suitability of steam cracker tars for processing in accordance with the present invention, other heavy oils may be upgraded in accordance with the present invention. Such heavy oils include those oils customarily charged to cracking processes, e.g., whole crudes, and heavy distillate and residual fractions therefrom, and may also broadly include hydrogen deficient oils, such as shale oils, asphalts, tars, pitches, coal tars, heavy synthetic oils and the like, in addition to other oils.

In general, therefore, the process of the present invention is a conversion process wherein SCT or a heavy oil is admixed with an HDD boiling above 260° F., and preferably within the range 400° F. to 1050° F., and reacting the resulting mixture under hydrogen donor diluent reaction conditions. For purposes of the present invention, however, it is important to introduce the hydrogen donor diluent at or downstream of the quench point of the gas oil steam cracker furnace.

With the foregoing in mind, the present invention is directed to a process for cracking a hydrocarbon feedstock which involves reacting aromatic molecules containing such unsaturated functional groups with hydrogen donor diluent molecules to inhibit the aromatic molecules containing unsaturated functional groups from reacting to form heavier molecular weight products, and specifically asphaltenes.

The process for cracking a hydrocarbon feedstock in accordance with the present invention also involves supplying a hydrocarbon feedstock into a high temperature zone heated to a temperature within the range of about 800° F.–1800° F. to produce a high temperature product stream comprising such aromatic molecules containing such aromatic functional groups, preferably wherein the temperature is within the range of 1250° F.–1800° F., wherein the high temperature zone is a steam cracker and the hydrocarbon feedstock is subjected to steam cracking conditions to form a resultant high temperature steam cracked product stream comprising the aromatic molecules containing the unsaturated functional groups. In the embodiment where the temperature is within the range of about 850° F.–1100° F., the high temperature zone is a catalytic cracker. In yet another embodiment where the temperature is within the range of about 800° F.–1250° F., the high temperature zone is a coking furnace.

In accordance with the present invention, the process also involves introducing the hydrogen donor diluent into the high temperature steam cracked product stream in an amount up to a level up to about 100% by total weight, preferably wherein the amount of the hydrogen donor diluent level is up to about 60% by total weight of said high temperature steam cracked product stream, and more preferably wherein the level is an amount of the hydrogen donor diluent of at least about 1% by total weight of the high temperature steam cracked product stream.

The present invention also involves preparing the hydrogen donor diluent for introducing into the high temperature steam cracked product stream by subjecting a stream containing multi-ring aromatic compounds to hydrotreating conditions to form compounds comprising partially saturated rings, wherein the hydrotreating conditions are sufficient to achieve partial saturation, i.e., a hydrogen partial pressure within the range of about 100 lbs./psig. to about 2,500 lbs./psig.

In accordance with the present invention, in the instances where the temperature of hydrotreating is within the range of 400° F. to about 750° F., a hydrogen donor diluent is produced which has a boiling temperature range within the temperature range of about 500° F. to about 900° F., and the resultant high temperature steam cracked product has a steam cracked product temperature within the range of about 1300° F. to about 1600° F.

The process for cracking a hydrocarbon feedstock of the present invention also involves discharging the high temperature steam cracked product including the steam cracked product temperature into a heat soaking vessel and cooling the steam cracked product stream to a cool down temperature within the range of about 300° F. to about 755° F., and preferably wherein the cool down temperature is within the range of about 435° F. to about 620° F.

The cooling preferably involves subjecting the high temperature steam cracked product to an indirect heat exchange prior to introducing the hydrogen donor diluent to the stream cracked product to inhibit the reacting of the aromatic molecules containing functional groups to form heavier molecular weight products, wherein the indirect heat exchange reduces the temperature of the steam cracked product to a sufficiently low temperature to inhibit the reaction of the aromatic molecules containing functional groups to form a heavier molecular weight product, and wherein the steam cracked product is maintained at said sufficiently low temperature for a sufficiently long period of time to inhibit the reaction of the aromatic molecules containing functional groups to form heavier molecular weight products.

In accordance with the present invention, the hydrogen donor diluent is preferably introduced to the heat soaking vessel at a temperature within the range of about 500° F. to about 900° F., and the process also involves adding quench oil to the heat soaking vessel in order to quench the reacting of the aromatic molecules containing functional groups to form heavier molecular weight products. Preferably the quench oil is added as a quenching mixture with the hydrogen donor diluent to the heat vessel to form a quenched mixture having a quenched mixture temperature within the range of about 500° F. -650° F., wherein the quenched mixture of the steam cracked product, the hydrogen donor diluent and the quench oil is maintained in the heat soaking vessel for a time sufficient to inhibit the reacting of the aromatic molecules containing the functional group to form heavier molecular weight products, wherein the time is within the range of about 1 minute to about 240 minutes, and preferably is within the range of about 15 to about 30 minutes.

The quench oil is selected from a group of unhydrogenated precursors selected from the group consisting of naphthalene, phenanthrene, pyrene, quinoline, and hydroquinone, and alkyl derivatives of naphthalene, phenanthrene, pyrene, quinoline, and hydroquinone, and alkyl derivatives; the unhydrogenated precursors may also be selected from the group consisting of aromatic molecules containing phenol groups and aromatic molecules containing non-phenolic oxygen substitutes; or the unhydrogenated precursors may be selected from the group consisting of steam cracked quench oils, steam cracked tars, cat cracked tars, cat cracked cycle oils, cat cracked bottoms, coker gas oils, coal tar oils, and aromatic extent oils and cuts of steam cracked quench oils, steam cracked tars, cat cracked tars, cat cracked cycle oils, cat cracked bottoms, coker gas oils, coal tar oils, and aromatic extract oils.

The present invention is also directed to a process for cracking a hydrocarbon feedstock to produce normally gaseous olefins which involves supplying a hydrocarbon feedstock stream into a high temperature cracking zone to produce high temperature cracked product streams; introducing at least one hydrogen donor diluent into the high temperature cracked product stream; and recovering a liquid product stream containing a diminished asphaltic material content, preferably wherein the introducing step involves injecting the hydrogen donor diluent at or downstream of a point where high temperature cracking reactions are stopped by cooling below high temperature cracking reaction temperatures. For purposes this embodiment of the present invention, the cooling in the process for cracking a hydrocarbon feedstock involves subjecting the high temperature steam cracked product to indirect heat exchange to stop the high temperature cracking reactions. In this embodiment of the present invention, the high temperature thermal cracking zone has a temperature between 800° F. and 1800° F. Preferably the hydrogen donor diluent is introduced at a rate of 1 to 300 percent on liquid product rate, and is added in an amount up to about 100% by total weight, preferably wherein the amount is up to about 60% by total weight.

The process for cracking a hydrocarbon feedstock in accordance with the present invention, as described above, also involves preparation of a hydrogen donor diluent for introduction into the cracked product stream by hydrotreating a stream containing multi- ring aromatic compounds under conditions suitable to form compounds containing both aromatic and partially saturated rings, wherein the hydrogen donor diluent is prepared by hydrogenation of a stock selected from the group consisting of shale oil, coal tars, cracked aromatic oils, and steam cracker liquids, preferably wherein the hydrogen donor diluent is hydrogenated steam cracker tar.

In accordance with the present invention, the hydrogen donor diluent may be selected from the group consisting essentially of partially hydrogenated catalytic cycle oils, lubricating base oil extracts, coker gas oils, steam cracked tar oils, and coal tar liquids, preferably wherein the hydrogen donor diluent is hydrotreated steam cracked oil, and wherein the liquid product stream is steam cracked tars.

In one embodiment, the cracked mixture may be subsequently separated to obtain the spent donor diluent and heavier gas oils. The spent diluent may then be partially hydrogenated, so as to regenerate it for return to the cracking step.

A process in accordance with the present invention will now be described in reference to FIG. 1 of the drawings. As illustrated, feedline 10 supplies a hydrocarbon stream to be cracked in a cracking furnace 12. The furnace effluent is quenched at the furnace outlet by cooling either by indirect heat exchange in transfer line exchanger (TLE) 14, or with direct liquid quench at quench point 30, or by a combination of indirect heat exchange and direct liquid quench. A hydrogen donor diluent (HDD) is introduced at the quench point 30 at the outlet of furnace 12, or if TLE is present, at a point within or downstream of the TLE. The hydrogen donor could also be introduced at a point downstream of the point where liquid quench is normally introduced. As previously indicated, HDD suitable for purposes of the present invention include a myriad of materials, as conventionally used in HDD processes. Preferred HDD for purposes of the present invention, however, are materials which have boiling points which overlap the liquid products of the steam cracking process, such as hydrotreated catalytic cracking oils, coker gas oils, steam cracked tar oils, and coal tar liquids. The HDD introduced at or after the quench point of the cracking furnace may be obtained by hydrotreating a steam cracked liquid stream, such as a portion of the normal quench oil or other steam cracked liquids subsequently obtained from the fractionation step, or may be supplied from a separate source, particularly for purposes of startup. The heated product stream is discharged from furnace 12 through line 16 to fractionator 18. The fractionator 18 may be of conventional design and operation, and is essentially a rectifying column from which a number of side-stream products may be drawn, as well as overhead liquid and vapor and bottoms. Although not shown, separate steam strippers may be used with each sidestream to eliminate "light ends" which would be returned to the main column. As shown in FIG. 1, however, the gases and light ends are removed through line 20, a gas oil fraction is removed through line 22, and a bottoms pitch or tar fraction are removed through line 24.

In accordance with the present invention, a portion or all of the gas oil fraction, or of a particular boiling range cut thereof, may be passed through line 22 to hydrotreater 26 where it is subjected to hydrotreating or hydrogenation to provide a hydrogen-rich donor diluent which may be returned via line 28 to the quench point 30 of the steam cracking furnace 12. Another embodiment of the present invention is to pass a portion or all of the tar or a particular boiling range cut thereof through line 24 to hydrotreater 32 wherein the steamed cracked tars are subjected to hydrotreating to provide a hydrogen-rich donor diluent which is returned via line 34 to the quench point 30 of the steam cracker furnace 12. As previously indicated, steam cracked oil or other heavy aromatic oil may be separately hydrotreated, for example in hydrotreater 36, and passed to the quench point 30 of cracking furnace 12 via line 38, or to supplement the supply of hydrogen donor diluent from the previously two described streams.

The main feature of the present invention, however, is that the HDD be introduced to the hydrocarbon stream being cracked at or downstream of the quench point 30 of the steam cracker furnace 12. In other respects, the specific process conditions in the various steps may be more or less conventional, and are subject to considerable variation depending upon feed stock characteristics, product fractions desired, equipment capabilities and the like.

As previously indicated, it is preferred to select HDD having boiling points which overlap the boiling points of the steam cracked liquid products. Thus, although the present invention has been generally described with respect to hydrotreating gas oil fractions and pitch or steam cracker tar fractions, it is also envisioned that other steam cracked sidestream fractions separated from the fractionater 18 or otherwise separated can be hydrotreated and can be used as a source of HDD. Nevertheless, as previously described hydrotreated steam cracker tar oils and other heavy aromatic oils are particularly suitable for upgrading steam cracked liquids in accordance with the present invention. Other suitable HDD include unhydrogenated precursors selected from the group consisting of naphthalene and its alkyl derivatives, anthracene and its alkyl derivatives, phenanthrene and its alkyl derivatives, pyrene and its alkyl-substituted derivatives, and other condensed aromatic molecules having 4 or more aromatic rings and their alkyl derivatives, quinoline and its alkyl derivatives, and other nitrogen containing aromatic molecules, hydroquinone and its alkyl derivatives, aromatic molecules containing phenol groups or other oxygen substituents, steam cracked gas oils and cuts thereof, steam cracked quench oils and cuts thereof, steam cracked tars and cuts thereof, cat cracked cycle oils and cuts thereof, cat cracked bottoms and cuts thereof, coker gas oils and cuts thereof, coal tar oils and cuts thereof and aromatic extract oils and cuts thereof.

Thus, it will be appreciated that specific process details of temperature, pressure, flow rates, product cuts and the like may be varied considerably according to the specific requirements and other circumstances. As previously indicated, the present invention is based upon the discovery that when HDD is mixed with samples of fresh, unheatsoaked steam cracked liquids and the mixture is subsequently heatsoaked, there is a suppression of molecular weight growth reactions such as the reactions which lead to the formation of asphaltenes relative to the case where samples of the same fresh, unheatsoaked steam cracked liquids are heatsoaked without the hydrogen donor diluent present.

EXAMPLES

The following examples show the utility of HDD for mitigating degradation reactions in steam cracked liquid products. The described experiments used a simple reactor apparatus to simulate the effects of heatsoaking steam cracked liquid products at temperatures normally encountered in the processing of these liquid products.

The experimental apparatus used for the heatsoaking experiments is commonly known as a tubing bomb reactor. The essence of the reactor is that it is constructed from stainless steel tubing and appropriate fittings, and is capable of operations at high temperatures and pressures. The volume of the reactor used for the following described Examples is about 30 cc.

The procedure for a typical experiment is to charge about 15 grams of reactants to the tubing bomb and then, after appropriate purging with inert gas and other procedures to assure safe operation, the tubing bomb is inserted into a preheated fluidized sandbath and held there for the desired reaction time. The tubing bomb reactor is then removed from the tubing bomb reactor and the sample is analyzed by a variety of techniques to determine the properties of the recovered material. One of the principal analytical procedures used is the determination of the asphaltene content using n-heptane as the precipitating solvent. Determination of asphaltene content using n-heptane or other paraffinic solvents is a well known technique to determine the amount of high molecular weight material in heavy hydrocarbon oil such as residua, heavy cat cracked products, coker gas oils, and steam cracked tars.

EXAMPLE 1

This example illustrates the harmful effects of heatsoaking steam cracked liquid products. A steam cracked tar product obtained from the transfer line of a conventional steam cracker prior to any substantial heatsoaking was subsequently heatsoaked in the test apparatus, as described above, for four hours at 300° C. After this time period the heptane insolubles content of the tar product had increased from about 10% in the unheatsoaked material to about 32% in the heatsoaked material. The increase in heptane insolubles content is indicative of substantial degradation of the tar product.

EXAMPLE 2

This example illustrates the utility of a HDD to mitigate undesirable degradation reactions due to heatsoaking steam cracked tar product. The same starting tar product as used in Example 1 was mixed with HDD to a level of 17% by weight HDD in the HDD/tar mixture. For this example, the HDD used was dihydroanthracene. As in example 1, the HDD/tar mixture was heatsoaked for four hours at 300° C. After this time period the heptane insolubles content calculated on a tar only basis had increased from about 10% to only about 20%. This example clearly shows the advantage of adding HDD to steam cracked liquid products in order to mitigate degradation reactions.

EXAMPLE 3

This example illustrates the utility of another HDD, hydrogenated pyrene, for mitigating degradation reactions in steam cracked liquid products due to heatsoaking. Hydrogenated pyrene was prepared by partially hydrogenating pyrene, an aromatic molecule typical of polycondensed aromatics found in steam cracked tar products. Hydrogenated pyrene was mixed to a level of 17% by weight with the same starting tar product used in Examples 1 and 2. This mixture of HDD and tar was then heatsoaked for four hours at 300° C. in the same apparatus used in the previous examples. After this time period, the steam cracked tar product had a heptane insolubles content of about 24% calculated on a tar only basis. This compares to 32% heptane insolubles in a heatsoaked tar without HDD addition as described in Example 1 above.

EXAMPLE 4

This example illustrates that the HDD must have unique hydrogen donating capabilities to be effective for suppressing degradation reactions in steam cracked liquid products. Seventeen parts steam cracked gas oil were mixed with 83 parts of the same steam cracked tar product used in Examples 1 to 3. This mixture was heatsoaked for four hours at 300° C. in the same manner as in the previous examples. After this heatsoaking period, the heptane insolubles were measured to be about 30% which is nearly the same amount as originally measured in heatsoaked tar without any additive as described in Example 1. This example illustrates the importance of selecting the proper HDD stream in order to properly effect the hydrogen donor chemistry to suppress degradation reactions. Dihydroanthracene and hydrogenated pyrene are both effective HDD materials as illustrated in Examples 2 and 3. An unhydrogenated aromatic oil such, as steam cracked gas oil, is ineffective as an HDD, as demonstrated in this present example.

EXAMPLE 5

This example illustrates that the useful HDD chemistry can be effected over a wide concentration range of HDD in steam cracked liquid products. In the following table, experimental results are presented showing the effect of HDD content on heptane insolubles content in a heatsoaked steam cracked tar product. The same steam cracked tar product used in the previous examples was mixed with varying amounts of HDD material prior to heatsoaking for four hours at 300° C. after which the heptane insolubles content of the tar product was measured.

| | Heptane Insolubles in Steam Cracked Tar | |
|---|---|---|
| HDD: Wt. % HDD Added | Dihydroanthracene | Hydrogenated Pyrene |
| 0 | 32 | 32 |
| 4 | 29 | 28 |
| 11 | 25 | 27 |
| 17 | 21 | 24 |

This example demonstrates that HDD materials such as dihydroanthracene and hydrogenated pyrene are effective for suppressing steam cracked liquid product degradation reactions over a wide concentration range.

EXAMPLE 6

This example illustrates that the utility of the present invention with respect to the use of HDD to suppress asphaltene formation is not limited by the source of the reactive tar product. A liquid steam cracked tar product was obtained from the transfer line of a steam cracking furnace located at a different plant from the source of the starting SCT product used in the above examples. For this new SCT product sample, the original asphaltene content was found to be only 4.5% before the product was subjected to heatsoaking at elevated temperatures. After heatsoaking at 260° C. for one hour in an apparatus similar to that used above, the asphaltene content was found to be 22%. This again illustrates the harmful effects of high temperature heatsoaking of SCT liquid products in the absence of a suitable HDD. When the above experiment is repeated with the addition of 20% dihydroanthracene HDD, the asphaltene content only increases to 8.6% corrected to a HDD free basis, which again illustrates that the effectiveness of HDD to suppress the harmful reactions leading to asphaltene formation reactions is not restricted to the particular plant source of the SCT product and, furthermore, is only related to the presence of reactive asphaltene precursor molecules which are normally found in the liquid effluent of a steam cracking process.

EXAMPLE 7

This example illustrates several important features of this invention. The previous Examples 1 to 6 all used heatsoaking equipment which was operated at ambient pressure. In this example, the equipment has been modified to operate at higher pressures. The following table shows the effect of HDD concentration on asphaltene formation when using the HDD molecule, dihydroanthracene. The two starting SCT products were obtained from the same commercial plant, but at two different times. As can be seen in the table, these two SCT products have significantly different asphaltene contents, but, most importantly, both samples respond favorably to the presence of HDD when subjected to heatsoaking at elevated temperature. This again illustrates that the harmful reactive precursors for asphaltene formation are typically found in the normal liquid product effluent from a steam cracking process, albeit in different concentrations.

HDD: Dihydroanthracene (DHA)
Reactor Temperature: 300° C.
Reactor Pressure: 3 barg
Reaction Time: 1 hour

| | % Asphaltenes in SCT Product: | |
|---|---|---|
| DHA Concentration | 1 | 2 |
| No Heatsoaking | 13 | 5 |
| 0 | 34 | 23 |
| 15 | 23 | 11 |
| 25 | 13 | 5 |
| 50 | 11 | 2 |

(Note: Asphaltene content expressed on DHA free basis) In the above table, it is noted that SCT products, 1 and 2, have significantly different asphaltene contents both before any heatsoaking and after heatsoaking in the absence of the HDD, DHA. However, when each of these samples are heatsoaked in the presence of DHA, both respond favorably in that the asphaltene content is lower than that found when heatsoaked in the absence of the HDD and DHA. Furthermore, under the conditions of these experiments, particularly the higher pressure of 3 barg, both samples show significantly less asphaltene formation for higher concentrations of HDD of 25 and 50 percent. This is attributed to the higher pressure facilitating better contact of the HDD molecule, DHA, with the reactive asphaltene precursor molecules, particularly the lower molecular weight reactive molecules which have a higher vapor pressure at 300° C. than the HDD molecule. This illustrates the importance of maintaining good contact between the HDD and the reactive molecules in the effluent from the steam cracking process. Given that the effectiveness of the HDD is evident for both SCT products 1 and 2 is further evidence that the beneficial effects of adding HDD to the product from the steam cracking furnace is not restricted to or limited by a particular product source and is indicative of the common nature of the reactions between HDD and reactive asphaltene precursor molecules normally found in the product effluent from a steam cracking process.

EXAMPLE 8

The example illustrates that a fraction of a typical liquid product from a steam cracking process can be hydrogenated using conventional hydrotreating technology to produce an effective HDD. Quench Oil (typical boiling range of about 220° C. to 350° C.) from a steam cracking process was hydrotreated under mild conditions of about 250° C., 40 barg total pressure, 1 LHSV, and a flowrate of 180 cc Hydrogen per 1 cc of liquid feed using a conventional sulfided Ni- $Mo/Al_2O_3$ catalyst and a typical hydrotreating apparatus. When 15 parts of this hydrogenated quench oil was mixed with 85 parts of the same steam cracked tar product used in Examples 1 to 5 and then heatsoaked for 4 hours at 300° C. in the apparatus described above but, with a nitrogen overpressure of 25 barg added to the reactor before starting the experiment in order to assure that all of the added HDD remained in the liquid phase, the asphaltene content of the steam cracked tar product was about 24% which compares favorably with an asphaltene content of about 30% when the experiment is repeated without the addition of hydrogenated quench oil. This experiment, when repeated with a mixture of 30 parts hydrogenated quench oil and 70 parts steam cracked tar product, resulted in the formation of only 22% asphaltenes in the steam cracked tar product.

These experiments are useful to illustrate that an indigenous aromatic oil from the steam cracking process can be hydrotreated to produce an effective HDD.

The effectiveness of the process of the present invention in upgrading steam cracked liquids is evidenced by comparing the level of asphaltenes and other insolubles in steam cracked liquids which have been heatsoaked in mixture with HDD to the levels in steam cracked liquids which have been heatsoaked without HDD present. The results of such a comparison are shown below for an actual SCT material before and after processing:

TABLE 1

| | |
|---|---|
| Asphaltenes before treatment | 34% |
| Asphaltenes after treatment | 11-23% |

The above illustrates that 25-67% of asphaltic material in the steam cracker tars was prevented from forming by treatment in accordance with the present invention.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for cracking a hydrocarbon feedstock, said process comprising:

a) supplying a hydrocarbon feedstock into a high temperature zone heated to a temperature within the range of about 800° F.-1800° F. to produce a high temperature product stream comprising aromatic molecules containing unsaturated functional groups; and b) reacting said aromatic molecules containing unsaturated functional groups with hydrogen donor diluent molecules selected from the group consisting of partially saturated aromatic molecules and hydrogenated aromatic oils to inhibit said aromatic molecules containing unsaturated functional groups from reacting to form heavier molecular weight products.

2. The process for cracking a hydrocarbon feedstock of claim 1, wherein said partially saturated aromatic molecules are selected from the group consisting of dihydronaphthalenes, tetrahydronaphthalenes, dihydroanthracenes, dihydrophenanthrenes, tetrahydroanthracenes, tetrahydrophenanthrenes, and hydropyrenes.

3. The process for cracking a hydrocarbon feedstock of claim 1, wherein said hydrogenated aromatic oils are selected from the group consisting of steam cracked liquid products, cat cracker cycle oils, coker gas oils, and coal tar liquids.

4. The process for cracking a hydrocarbon feedstock of claim 1, wherein said unsaturated functional groups of said aromatic molecules are selected from the group consisting of olefinic groups and acetylenic groups.

5. The process for cracking a hydrocarbon feedstock of claim 1, wherein said unsaturated functional groups of said aromatic molecules are selected from the group consisting of cyclopenteno-aromatics, vinyl aromatics and divinyl aromatics.

6. The process for cracking a hydrocarbon feedstock of claim 5, wherein said cyclopenteno-aromatics are selected from the group consisting of indenes, and acenapthalenes.

7. The process for cracking a hydrocarbon feedstock of claim 5, wherein said vinyl aromatics and divinyl aromatics are selected from the group of vinyl aromatics and divinyl aromatics having 2 or more aromatic rings.

8. The process for cracking a hydrocarbon feedstock of claim 5, wherein said vinyl aromatics and divinyl aromatics are selected from the group consisting of vinylbenzenes, vinylnaphthalenes, divinylnaphthalenes, vinylanthracenes, and vinylphenanthrenes.

9. The process for cracking a hydrocarbon feedstock of claim 1, wherein said heavier molecular weight products are asphaltenes.

10. The process for cracking a hydrocarbon feedstock of claim 1, wherein said temperature is within the range of about 1250° F.-1800° F.

11. The process for cracking a hydrocarbon feedstock of claim 10, wherein said high temperature zone is a steam cracker and said hydrocarbon feedstock is subjected to steam cracking conditions to form a resultant high temperature steam cracked product stream comprising said aromatic molecules containing said unsaturated functional groups.

12. The process for cracking a hydrocarbon feedstock of claim 1, wherein said temperature is within the range of about 850° F.-1100° F.

13. The process for cracking a hydrocarbon feedstock of claim 12, wherein high temperature zone is a catalytic cracker.

14. The process for cracking a hydrocarbon feedstock of claim 1, wherein said temperature is within the range of about 800° F.-1250° F.

15. The process for cracking a hydrocarbon feedstock of claim 11, wherein said high temperature zone is a coking furnace.

16. The process for cracking a hydrocarbon feedstock of claim 11, wherein said process further comprises introducing said hydrogen donor diluent into said high temperature steam cracked product stream in an amount up to a level up to about 100% by total weight.

17. The process for cracking a hydrocarbon feedstock of claim 16, wherein said amount of said hydrogen donor diluent level is up to about 60% by total weight of said high temperature steam cracked product stream.

18. The process for cracking a hydrocarbon feedstock of claim 16, wherein said level is an amount of said hydrogen donor diluent of at least about 1% by total weight of said high temperature steam cracked product stream.

19. The process for cracking a hydrocarbon feedstock of claim 16, further comprising preparing said hydrogen donor diluent for introducing into said high temperature steam cracked product stream by subjecting a stream containing multi-ring aromatic compounds to hydrotreating conditions to form compounds comprising partially saturated rings.

20. The process for cracking a hydrocarbon feedstock of claim 19, wherein said hydrotreating conditions are sufficient to achieve partial saturation.

21. The process for cracking a hydrocarbon feedstock of claim 20, wherein said hydrotreating conditions comprise a hydrogen partial pressure within the range of about 100 lbs./psig. to about 2,500 lbs./psig.

22. The process for cracking a hydrocarbon feedstock of claim 20, wherein said hydrotreating conditions comprise a temperature within the range of 400° F to about 750° F. to result in a hydrogen donor diluent having a boiling temperature range within temperature range within the range of about 500° F. to about 900 ° F.

23. The process for cracking a hydrocarbon feedstock of claim 22, wherein said high temperature steam cracked product has a steam cracked product temperature within the range of about 1300° F. to about 1600° F.

24. The process for cracking a hydrocarbon feedstock of claim 23, further comprising discharging said high temperature steam cracked product having said steam cracked product temperature into a heat soaking vessel and cooling said steam cracked product stream to a cool down temperature within the range of about 300° F. to about 755° F.

25. The process for cracking a hydrocarbon feedstock of claim 24, wherein said cool down temperature is within the range of about 435° F. to about 620° F.

26. The process for cracking a hydrocarbon feedstock of claim 25, wherein said introducing said hydrogen donor diluent comprises supplying said hydrogen donor diluent to said heat soaking vessel at a temperature within the range of about 500° F. to about 900° F.

27. The process for cracking a hydrocarbon feedstock of claim 26, further comprising adding quench oil to said heat soaking vessel in order to quench said reacting of said aromatic molecules containing functional groups to form heavier molecular weight products.

28. The process for cracking a hydrocarbon feedstock of claim 27, wherein said quench oil is added as a quenching mixture with said hydrogen donor diluent to said heat vessel to form a quenched mixture having a quenched mixture temperature within the range of about 500° F.-650° F.

29. The process for cracking a hydrocarbon feedstock of claim 28, wherein said quenched mixture of said steam cracked product, said hydrogen donor diluent and said quench oil is maintained in said heat soaking vessel for a time sufficient to inhibit said reacting of said aromatic molecules containing functional group to form heavier molecular weight products.

30. The process for cracking a hydrocarbon feedstock of claim 29, wherein said time is within the range of about 1 minute to about 240 minutes.

31. The process for cracking a hydrocarbon feedstock of claim 30, wherein said time is within the range of about 15 to about 30 minutes.

32. The process for cracking a hydrocarbon feedstock of claim 27, wherein said quench oil is selected from the group of unhydrogenated precursors.

33. The process for cracking a hydrocarbon feedstock of claim 32, wherein said unhydrogenated precursors are selected from the group consisting of naphthalene, phenanthrene, pyrene, quinoline, and hydroquinone, and alkyl derivatives of naphthalene, phenanthrene, pyrene, quinoline, and hydroquinone, and alkyl derivatives.

34. The process for cracking a hydrocarbon feedstock of claim 32, wherein said unhydrogenated precursors are selected from the group consisting of aromatic molecules containing phenol groups and aromatic molecules containing non-phenolic oxygen substitutes.

35. The process for cracking a hydrocarbon feedstock of claim 32, wherein said unhydrogenated precursors are selected from the group consisting of steam cracked quench oils, steam cracked tars, cat cracked tars, cat cracked cycle oils, cat cracked bottoms, coker gas oils, coal tar oils, and aromatic extent oils and cuts of steam cracked quench oils, steam cracked tars, cat cracked tars, cat cracked cycle oils, cat cracked bottoms, coker gas oils, coal tar oils, and aromatic extract oils.

36. The process for cracking a hydrocarbon feedstock of claim 24, wherein said cooling comprises subjecting said high temperature steam cracked product to an indirect heat exchange prior to said introducing said hydrogen donor diluent to said stream cracked product to inhibit said reacting of said aromatic molecules containing functional groups to form heavier molecular weight products.

37. The process for cracking a hydrocarbon feedstock of claim 36, wherein said indirect heat exchange reduces the temperature of said steam cracked product to a sufficiently low temperature to inhibit said reacting of said aromatic molecules containing functional groups to form heavier molecular weight product.

38. The process for cracking a hydrocarbon feedstock of claim 37, wherein said steam cracked product is maintained at said sufficiently low temperature for a sufficiently long period of time to inhibit said reacting of said aromatic molecules containing functional groups to form heavier molecular weight products.

* * * * *